US008201713B2

(12) United States Patent
Bourque et al.

(10) Patent No.: US 8,201,713 B2
(45) Date of Patent: Jun. 19, 2012

(54) PRESSURE COMPENSATION MEMBER

(75) Inventors: Steven Michael Bourque, Billerica, MA (US); M. Scott Curry, Woburn, MA (US); Michael Thomas DeMellia, Haverhill, MA (US); Andrew James Ford, Stoneham, MA (US); Maurice Paul Matte, Billerica, MA (US); Timothy Collin Wheatley, Beverly, MA (US)

(73) Assignee: The Procter & Gamble Company, Cincinnati, OH (US)

( * ) Notice: Subject to any disclaimer, the term of this patent is extended or adjusted under 35 U.S.C. 154(b) by 332 days.

(21) Appl. No.: 12/422,905

(22) Filed: Apr. 13, 2009

(65) Prior Publication Data

US 2010/0032438 A1 Feb. 11, 2010

Related U.S. Application Data

(60) Provisional application No. 61/044,632, filed on Apr. 14, 2008.

(51) Int. Cl.

| | |
|---|---|
| ***B65D 83/00*** | (2006.01) |
| ***F16K 31/12*** | (2006.01) |
| ***F16K 31/363*** | (2006.01) |
| ***F16K 31/36*** | (2006.01) |

(52) U.S. Cl. ..... 222/402.1; 137/497; 138/46

(58) Field of Classification Search ..... 222/396, 222/402.1, 402.2, 402.25; 137/497, 504, 137/517; 138/40, 44, 45, 46; 239/337, 533.1, 239/570–572, 583

See application file for complete search history.

(56) References Cited

U.S. PATENT DOCUMENTS

| | | | | |
|---|---|---|---|---|
| 4,497,334 | A | 2/1985 | Wolf et al. | |
| 4,650,094 | A | 3/1987 | Werding | |
| 4,754,897 | A * | 7/1988 | Brace | 222/402.16 |
| 5,383,489 | A * | 1/1995 | Golestan et al. | 137/504 |
| 5,529,090 | A * | 6/1996 | Golestan et al. | 137/504 |
| 7,066,200 | B2 * | 6/2006 | Moesby et al. | 137/500 |

* cited by examiner

*Primary Examiner* — Darren W Gorman

(74) *Attorney, Agent, or Firm* — Jay A. Krebs; Ronald T. Sia; Mark A. Charles

(57) ABSTRACT

A pressure compensation member suitable to be placed in a fluid dispensing channel, a valve unit comprising this pressure drop compensation member and a container comprising this pressure compensation member or this valve unit are disclosed. The pressure compensation member is adapted to maintain a substantially constant flow of fluid through the fluid dispensing channel.

8 Claims, 14 Drawing Sheets

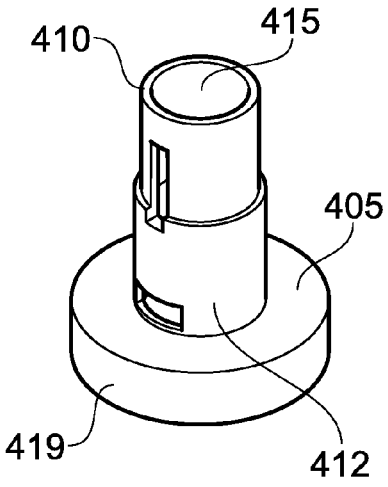
Fig. 4A
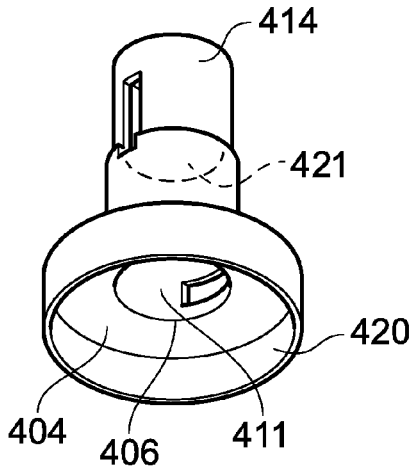
Fig. 4B
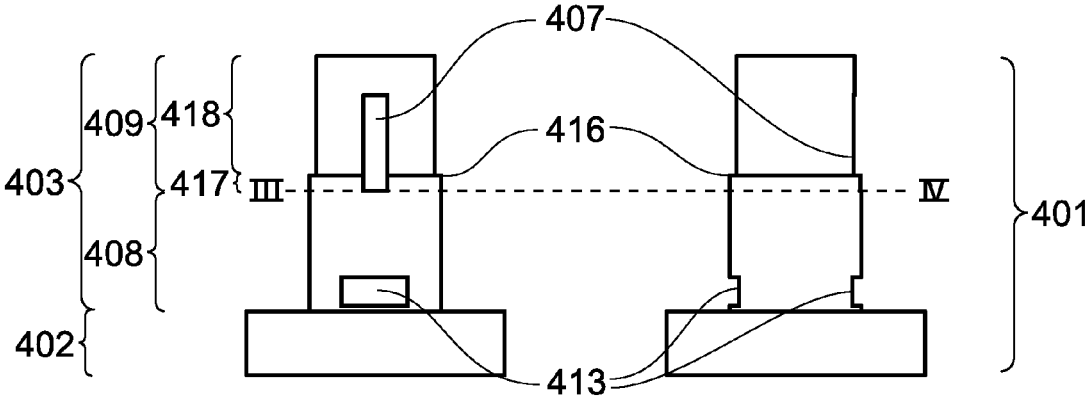
Fig. 4C
Fig. 4D

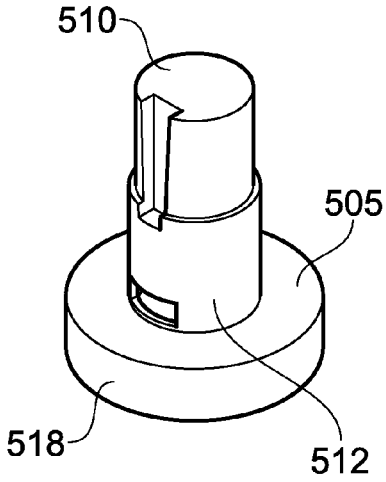
Fig. 5A
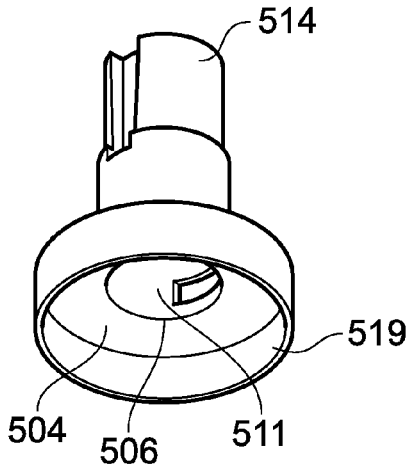
Fig. 5B
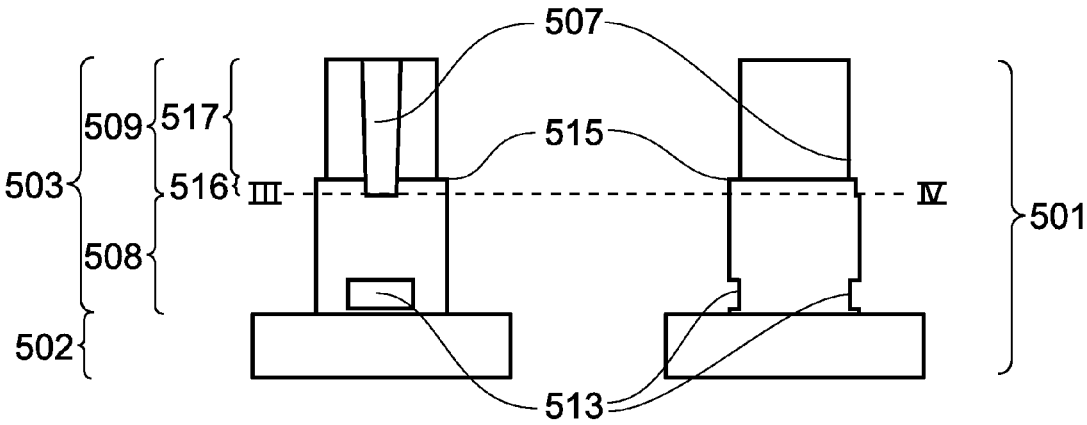
Fig. 5C
Fig. 5D

PRESSURE COMPENSATION MEMBER

CROSS REFERENCE TO RELATED APPLICATION

This application claims the benefit of U.S. Provisional Application Ser. No. 61/044,632, filed Apr. 14, 2008.

FIELD OF THE INVENTION

The present invention relates to a pressure compensation member suitable to be placed in a fluid dispensing channel, a valve unit comprising this pressure drop compensation member and a container comprising this pressure compensation member or this valve unit. The pressure compensation member is adapted to maintain a substantially constant flow of fluid through the fluid dispensing channel.

BACKGROUND OF THE INVENTION

Pressurization of fluids is usually achieved by inclusion of a liquefied propellant gas, such as propane and/or butane, which volatilizes on dispensing carrying out the composition to be dispensed. As the product is dispensed, the liquefied propellant gas vaporizes maintaining a constant pressure. With compressed gas systems, such as systems pressurized by air, upon use, as the volume of product in the container decreases, the pressure within the container also drops and the flow of fluid dispensed decreases proportionally.

The pressure drop can be overcome, at least partially, by incorporating a pressure compensation member in the fluid dispensing channel. See, for example U.S. Pat. No. 4,650,094 and U.S. Pat. No. 4,497,334. Nevertheless, there is a constant need for providing improved pressure compensation members. Particularly, there is a need for a pressure compensating member that is capable of maintaining a substantially constant fluid flow, even when the volume of the product in the container has decreased significantly. There is also a need for a pressure compensating member having an improved stability to prevent the alteration of the quality of the fluid flow, even when the volume of the product in the container has decreased significantly.

SUMMARY OF THE INVENTION

The present invention relates to a pressure drop compensation member suitable to be placed in a fluid dispensing channel. In accordance with one exemplary embodiment, the pressure drop compensation member comprises:

(a) a sleeve;

(b) a piston adapted to be acted upon by a fluid in a first direction, the piston comprising one or more flow slits adapted to allow fluid to flow through the piston; and (c) an elastic member capable of acting on the piston in a second direction opposite to the first direction;

wherein the piston is received within the sleeve and is slidably movable therein to adjust the area of each of the one or more flow flits available for fluid flow, subject to a minimum area of each of the one or more flow slits always being available for fluid flow, and wherein, in use, if the pressure exerted by the fluid on the piston drops, the elastic member acts to move the piston in relation to the sleeve to increase the area of each of the one or more flow slits in order to maintain a substantially constant flow of fluid through said fluid dispensing channel.

The present invention also relates to a valve unit comprising a one-way valve adapted to allow fluid to flow through the one-way valve in a flow direction upon actuation of the one-way valve, and a pressure drop compensation member located before the one-way valve in relation to the flow direction.

The present invention also relates to a container adapted for dispensing a pressurized fluid comprising a dispensing fluid channel comprising a pressure drop compensation member and/or a one-way valve.

BRIEF DESCRIPTION OF THE DRAWINGS

The invention may be better understood by reference to the following figures, which illustrate non-limiting embodiments of the present invention.

FIGS. 4*a*, 4*b*, 4*c* and 4*d* represent four different views of an exemplary piston embodiment.

FIGS. 5*a*, 5*b*, 5*c* and 5*d* represent four different views of another exemplary piston embodiment.

DETAILED DESCRIPTION OF THE INVENTION

Figure 1:
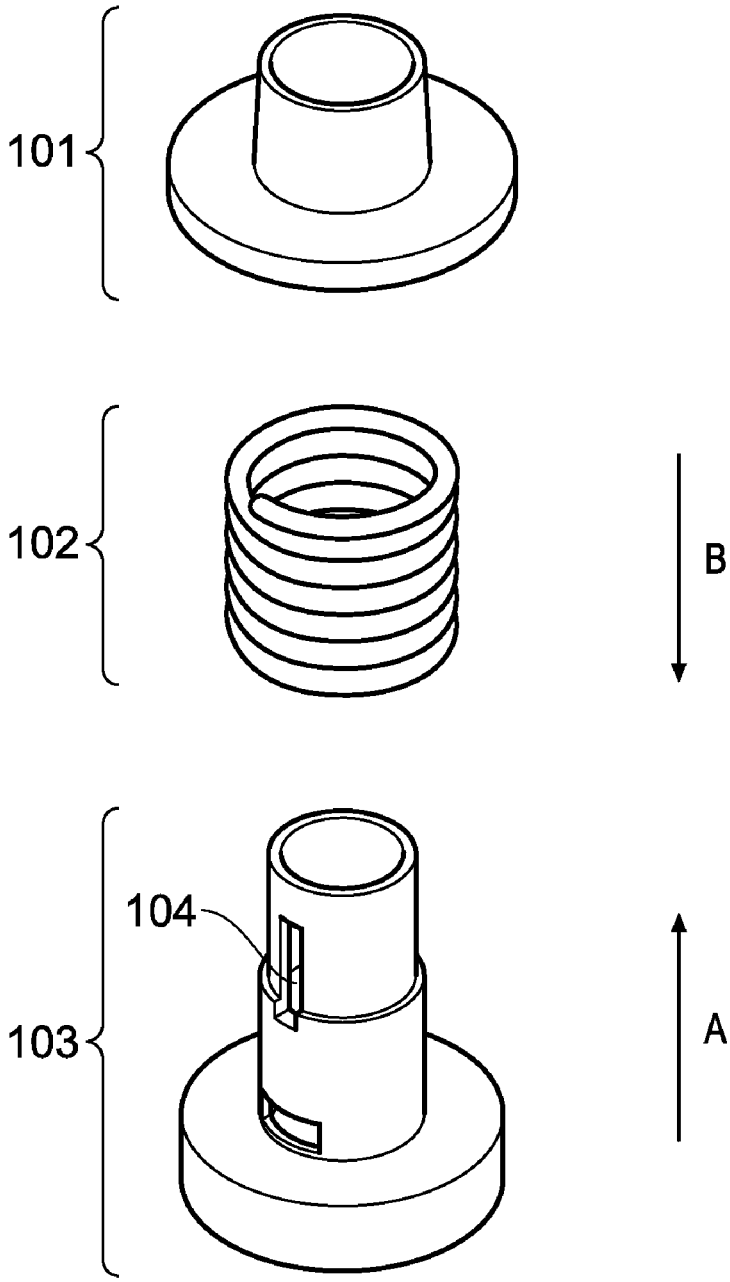
FIG. 1 represents a perspective exploded view of an exemplary pressure compensating member comprising a piston, a sleeve, and an elastic member.
Figure 2:
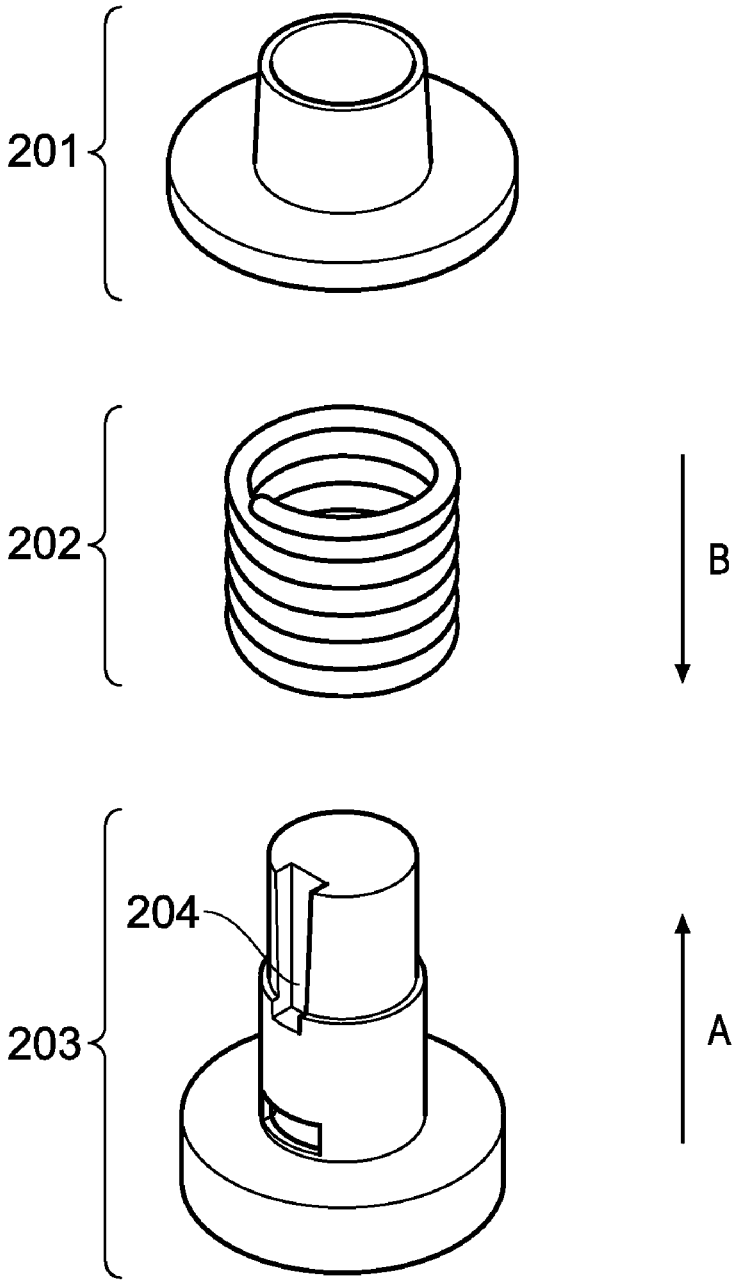
FIG. 2 represents a perspective exploded view of another exemplary pressure compensating member comprising a piston, a sleeve, and an elastic member.
Figure 3A:
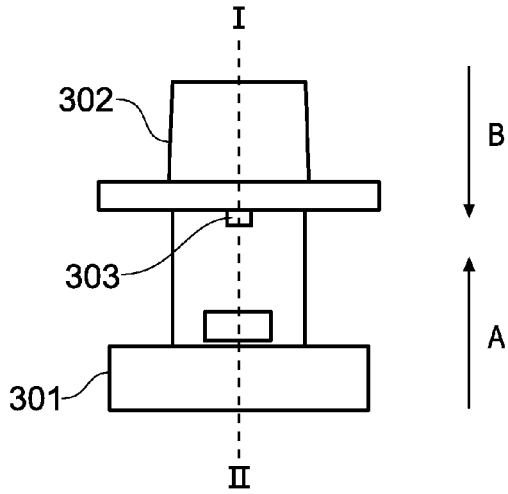
FIGS. 3*a* and 3*b* represent two views of a pressure compensating member when the pressure exerted by the fluid on the piston is maximal and minimal, respectfully.
Figure 3B:
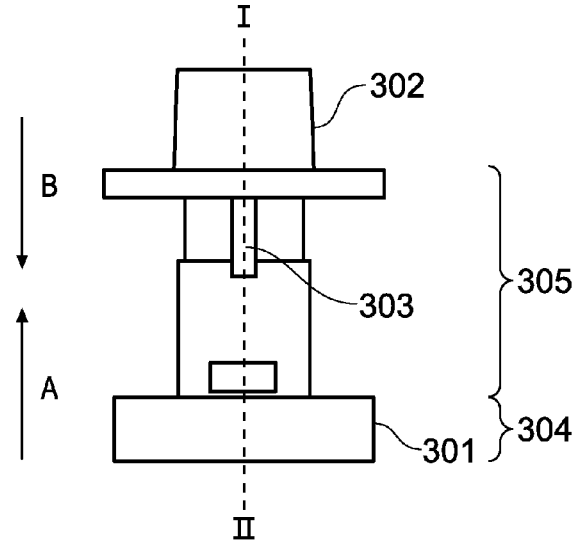

As shown in FIGS. 1 and 2, the present invention relates to a pressure compensation member suitable to be placed in a fluid dispensing channel, comprising a sleeve (101, 201), a piston (103, 203) comprising one or more flow slits (104, 204) adapted to allow fluid to flow through the piston (103, 203), and an elastic member, for example, a spring (102, 202). The piston (103, 203) is adapted to be acted upon by the fluid in a first direction (represented by the arrow A). The elastic member (102, 202) is capable of acting on the piston (103, 203) in a second direction (represented by the arrow B) opposite to the first direction. As shown in FIGS. 3*a* and 3*b*, the piston (301) is received within the sleeve (302) and is slidably movable therein to adjust the area of each of the one or more flow slits (303) available for fluid flow, subject to a minimum area of each of the one or more flow slits (303) always being available for fluid flow. It can be advantageous that the piston (301) moves slidably along an axis (represented by the dotted lines I-II) being substantially parallel to the first and second direction (represented respectively by arrows A and B) as the friction is minimized and the flow of the fluid through the piston is facilitated. It can also be advantageous that the fluid flows through at least one flow slit, instead of an annular rod for example, as this can contribute to the stability of the pressure compensation member by having at least a portion of the piston in close contact with the sleeve. This allows the piston to be movable only along an axis (I-II) being substantially parallel to the first (A) and second direction (B).

As shown in FIG. 3*a*, when a maximal pressure is exerted by the fluid on the piston (301) in the first direction (A), a minimum area of each of the one or more flow slits (303) is available for fluid flow. As shown in FIG. 3*b*, when the pressure exerted by the fluid on the piston (301) drops, the elastic member (not represented) acts to move the piston (301) in the second direction (B) in relation to the sleeve (302) to increase the area of each of the one or more flow slits (303) available for fluid flow. Consequently, the area of each of the one or more flow slits available for fluid flow is dependent on a balance between the pressures exerted on opposite directions on the piston respectively by the fluid and by the elastic member. Each flow slit (303) is designed so as to maintain a substantially constant flow of fluid through the fluid dispensing channel. Constant flow may be achieved by designing flow slits according to the fluid equation known as Poiseuille's law:

$$Q = \frac{\pi R^4 \Delta P}{8\ \mu L}$$

Wherein Q is the volumetric flow in units of volume per time;

R is the radius or equivalent radius of the cross sectional area of flow in units of length (an equivalent radius is the radius of a circle with the same cross sectional area as the orifice shape);

ΔP is the pressure drop from one side of the orifice to the other in units of force per unit area;

M is the viscosity of the fluid in units of mass per length-time;

L is the length of the orifice channel in units of length.

It is believed that, in spite of the pressure drop (ΔP) within the container, the fluid flow (Q) is maintained substantially constant through the fluid dispensing channel by adjusting the equivalent radius (R) and/or the length (L) of each flow slit. According to the present invention, the fluid flow (Q) may be maintained substantially constant by increasing the equivalent radius (R) of the flow slit proportionally to pressure drop (ΔP) and/or by reducing the length (L) of the flow slit proportionally to pressure drop (ΔP).

As shown in FIGS. 4 and 5, the piston (401, 501) comprises a base (402, 502) and a body (403, 503).

The base (402, 502) comprises a first surface (404, 504) adapted to be acted upon by the fluid in the first direction (A) and a second surface (405, 505). The base (402, 502) also comprises one or more flow ducts (406, 506) fluidly linking the first surface (404, 504) with the second surface (405, 505) to allow fluid to flow through the base (402, 502).

The body (403, 503) is attached to the second surface (405, 505) of the base (402, 502) and it comprises the flow slits (407, 507). As shown in FIGS. 3*a* and 3*b*, this body (305) is at least partially received within the sleeve (302). As shown in FIG. 3*a*, when a maximal pressure is exerted by the fluid on the piston base (304) in the first direction (A), a maximal portion of the body (305) is received within the sleeve (302) so that a minimum area of each flow slit (303) is available for fluid flow. As shown in FIG. 3*b*, when a minimal pressure is exerted by the fluid on the piston base (304) in the first direction (A), a minimum portion of the body (305) is received within the sleeve (302) so that a maximum area each flow slit (303) is available for fluid flow. The reception of the body within the sleeve, even when a minimal pressure is exerted, can be advantageous as it can contribute to the stability of the pressure compensation member. Particularly, the reception of the body (305) within the sleeve (302) limits, or even prevents, the sleeve (302) to move in any other direction than along an axis (represented by the dotted lines I-II) being substantially parallel to the first and second direction.

The body (403, 503) may comprise a proximal portion (408, 508) attached to the second surface (405, 505) and a distal portion (409, 509) attached to the proximal portion (408, 508), the proximal portion (408, 508) and the distal portion (409, 509) being located on either side of the dotted line III-IV represented in FIGS. 4 and 5. The distal portion (409, 509) defines a free end (410, 510) located distant from the base (402, 502), comprises the flow slit (407, 507), and is at least partially received within the sleeve.

The proximal portion (408, 508) may comprise a solid volume having an external surface (embodiment not represented) or, alternatively, a peripheral wall having internal surface (411, 511) and an external surface (412, 512). In the latter embodiment, the proximal portion (408, 508) comprises a peripheral wall having internal and external surfaces (respectively, 411, 511 and 412, 512), the internal surface (411, 511) defining an internal volume that is delimited at one end by the base (402, 502) and, at the other by the distal portion (409, 509). Preferably, this proximal portion (408, 508) also comprises one or more flow apertures (413, 513), fluidly linking the internal surface (411, 511) with the external surface (412, 512) to allow fluid to flow from the internal volume to the exterior of the proximal portion (408, 508), and the or each flow duct (406, 506) communicates directly with the internal volume of the proximal portion (408, 508) to allow fluid to flow through the base (402, 502) to the internal volume of the proximal portion (408, 508).

The distal portion (509) may comprise a solid volume having an external surface (514) or, alternatively, the distal portion (409) may comprise a peripheral wall having an internal surface (415) and an external surface (414). In the latter embodiment, the distal portion (409) comprises a peripheral wall having internal and external surfaces (respectively, 415 and 414), the internal surface (415) defining an internal volume that is delimited at one end by the proximal portion (408) and, at the other by the free end (410) located distant from the base (402).

When both the distal (409) and the proximal (408) portions comprise a peripheral wall having an internal surface (411) defining an internal volume and an external surface (412), the internal volumes of the proximal portion (408) and the distal portion (409) are separated by a means (shown in FIG. 4*b*) preventing the fluid from flowing directly from the internal volume of the proximal portion (408) to the internal volume of the distal portion (409). Preferably, this means is a transversal internal wall 421 disposed at the interface between the peripheral walls of the proximal portion (408) and the distal portion (409).

The distal portion (409, 509) may comprise a stop (416, 515) for the sleeve such that a minimum area of each flow slit (407, 507) is available for fluid flow.

When the flow slit defines a groove (507), the distal portion (509) of the body (503) may comprise either a solid volume having an external surface (514) or a peripheral wall having internal and external surfaces (embodiment not represented). When the flow slit defines an orifice (407), the distal portion (409) of the body (403) comprises a peripheral wall having internal and external surfaces (respectively, 415 and 414).

Figure 13:
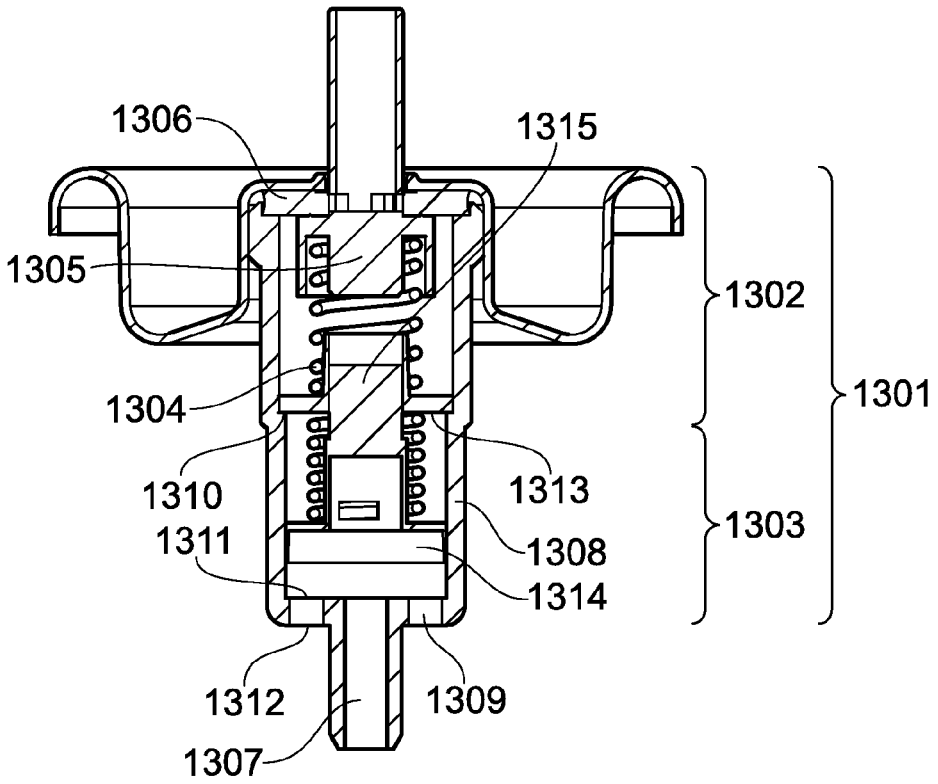
FIG. 13 is a cross-sectional view of the valve unit of FIG. 11, taken along the dotted line V-VI, and comprising a pressure drop compensating member according to the present invention.

When the flow slit defines a groove (507), the groove (507) extends from the free end (510) towards the base (502) to allow fluid to flow from the exterior of the distal portion (509) into the internal volume of the sleeve. As shown in FIG. 13, the piston (1314) may comprise a distal portion comprising a solid volume (1315) having an external surface. Alternatively, the distal portion may comprise a peripheral wall (embodiment not represented). When the distal portion comprises a peripheral wall having internal and external surfaces (embodiment not represented), the groove extends only partially from the external surface to the internal surface to prevent fluid to flow from the exterior of the distal portion into the internal volume and the free end of the distal portion is closed by a solid means to prevent fluid to flow back from the internal volume of the sleeve to the internal volume of the distal portion. This means may be a transversal wall attached to the free end.

In use, as the pressure exerted by the fluid on the piston (501) drops (ΔP), the portion of the piston (501) being received within the sleeve is reduced so that the length (L) of the groove (507) being received within the sleeve is also reduced. Depending on the design of the groove (507), the equivalent radius (R) of the groove (507) may also be reduced, increased or maintained constant. According to Poiseuille's law, the increase of the area of the groove (507) available for fluid flow, and consequently the reduction of the length (L) of the groove (507) being received within the sleeve, maintains a substantially constant flow of fluid through the fluid dispensing channel.

When the flow slit defines an orifice (407), the orifice (407) extends from the external surface (414) to the internal surface (415) to allow fluid to flow from the exterior of the distal portion (409) into the internal volume, the free end (410) defining an exit orifice to allow fluid to flow from the internal volume into the sleeve.

In use, as the pressure exerted by the fluid on the piston (401) drops (ΔP), the portion of the piston (401) being received within the sleeve is reduced so that the area of the orifice (407) available for fluid flow, and consequently the equivalent radius (R) of the orifice (407), is increased. In contrast, the length (L) of the orifice (407), i.e. the thickness of the peripheral wall, is generally maintained constant. According to Poiseuille's law, the increase of equivalent radius (R) of the orifice (407) being available for fluid flow maintains a substantially constant flow of fluid through the fluid dispensing channel.

Figure 6A:
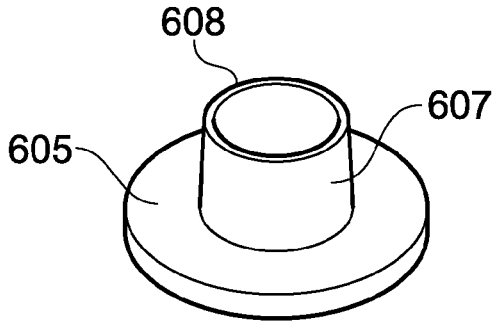
FIGS. 6*a*, 6*b* and 6*c* represent three different views of an exemplary sleeve embodiment of the pressure compensation member.
Figure 6B:
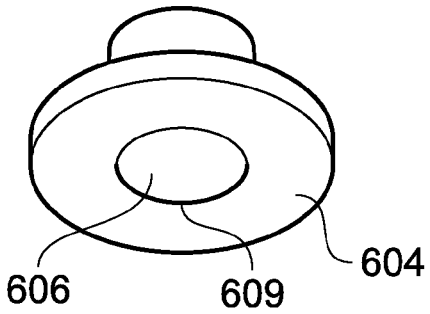
Figure 6C:
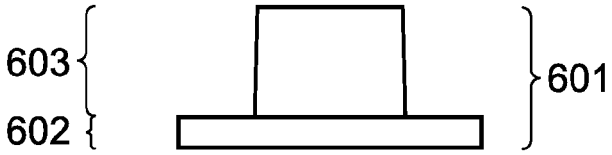
Figure 7A:
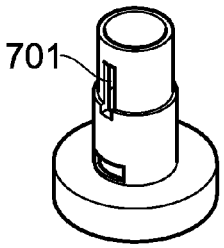
FIGS. 7*a*, 7*b*, 7*c* and 7*d* represent perspective views of four different executions of the piston embodiment shown in FIGS. 4*a*, 4*b*, 4*c* and 4*d*.
Figure 7B:
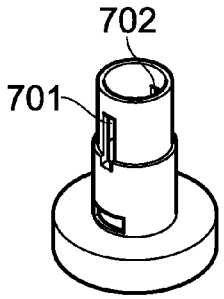
Figure 7C:
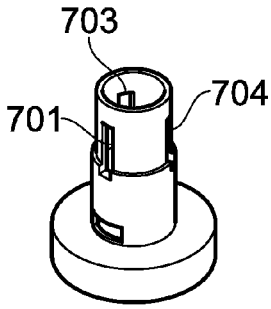
Figure 7D:
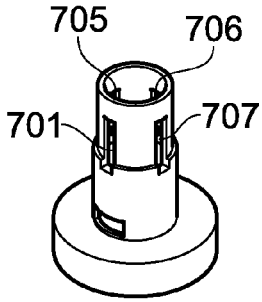
Figure 8A:
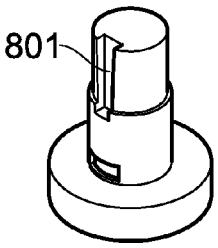
FIGS. 8*a*, 8*b*, 8*c* and 8*d* represent perspective views of four different executions of the piston embodiment shown in FIGS. 5*a*, 5*b*, 5*c* and 5*d*.
Figure 8B:
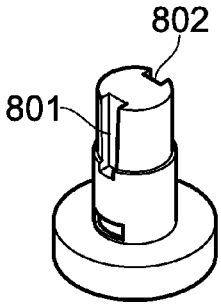
Figure 8C:
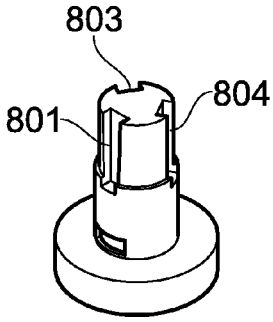
Figure 8D:
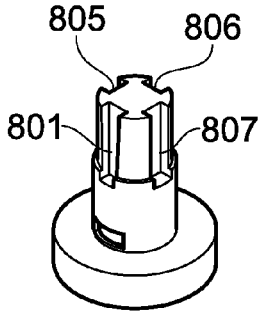

As shown in FIG. 6, the sleeve (601) may comprise a base (602) and a body (603). The sleeve base (602) comprises a first surface (604) adapted to be the seat of the elastic member and a second surface (605). The sleeve body (603) is attached to the second surface (605) of the sleeve base (602) and receives partially the piston body. The sleeve body (603) comprises a peripheral wall having an internal surface (606) and an external surface (607), the internal surface (606) defining an internal volume that is delimited at one end by the sleeve base (602) and, at the other by the free end (608) located distant from the sleeve base (602).

The elastic member (102, 202) may be any means capable of acting on the piston (103, 203) in the second direction (B). Preferably, the elastic member is a spring (102, 202).

FIGS. 1 to 5 represent the two different exemplary embodiments. In these embodiments, the proximal portion (408, 508) and the distal portion (409, 509) of the piston body (403, 503) are cylinders having a circular section and being co-axial to each other. The distal portion (409, 509) comprises two parts having different external diameters. The first part (417, 516), being attached to the proximal portion (408, 508), and the proximal portion (408, 508) have substantially the same external diameter. The second part (418, 517) of the distal portion (409, 509), being distant to the proximal portion (408, 508) and being the part that may be received within the sleeve, has an external diameter being smaller to the first portion (417, 516). The interface between the first and the second portions of the distal portion forms a step (416, 515) constituting a stop for the sleeve. The or each flow slit (407, 507) straddles the first and the second parts (respectively 417, 516 and 418, 517) of the distal portion (409, 509) so that the area of each flow slit (407, 507) located in the first part (417, 516) of the distal portion (409, 509) constitutes the minimum area being available for fluid flow when a maximal pressure is exerted by the fluid on the piston (401, 501).

In the embodiment according to FIG. 4, the flow slit defines an orifice (407) and the two parts (respectively, 417 and 418) of the distal portion (409) and the proximal portion (408) comprise peripheral walls having internal surfaces (415, 411) and external surfaces (414, 412), the internal surfaces (415, 411) defining an internal volume having substantially the same internal diameter. The internal volume of the first (417) and second (418) part of the distal portion (409) and the internal volume of the proximal portion (408) are separated by a means comprising a transversal wall having the shape of a disc (not represented). The orifice is rectangular is shape. The peripheral walls of the distal portion (409) have a constant thickness and so the length of the orifice (407) is maintained constant. Consequently, in use, as the pressure exerted by the fluid on the piston (401) drops, only the minimum area (i.e. the equivalent radius) of the orifice (407) available for fluid flow increases in order to maintain a constant flow of fluid through the fluid dispensing channel.

In the embodiment according to FIG. 5, the flow slit defines a groove (507). This groove (507) is conical in shape with the end distant to the proximal portion (508) being larger than the end close to the proximal portion (508). Consequently, in use, as the pressure exerted by the fluid on the piston (501) drops, the length of the groove (507) being received within the sleeve decreased and the equivalent radius increases in order to maintain a constant flow of fluid through the fluid dispensing channel.

The piston base (402, 502) is a cylinder having a circular section of substantially constant external diameter and being co-axial with the proximal portion (408, 508) and the distal portion (409, 509) of the piston body (403, 503). The length of the cylinder is smaller than the diameter so that the base (402, 502) has a shape of a disc. The external diameter is larger than the external diameter of the proximal portion (408, 508) of the piston body (403, 503) so that the second surface (405, 505) forms a seat for the elastic member. The base (402, 502) comprises one central flow duct (406, 506) having a diameter being substantially identical to the internal diameter of the proximal portion (408, 508).

The piston base (402, 502) also comprises a peripheral wall having internal and external surfaces (respectively 420, 519 and 419, 418) and being attached to the first surface (404, 504) of the piston base (402, 502). This peripheral wall is a cylinder having a circular section of substantially constant diameter and being co-axial with the piston body (403, 503).

The external diameters of the first surface (404, 504) of the piston base (402, 502) and this peripheral wall are substantially identical.

The sleeve body (603) comprises a peripheral wall having an internal surface (606) and an external surface (607).

This internal surface (606) of the sleeve body (603) is a cylinder having a circular section of substantially constant internal diameter and being co-axial with the distal portion (409, 509) of the piston body (403, 503). The internal diameter of this internal surface (606) is substantially identical to the external diameter of the external surface (414, 514) of the second part (418, 517) of the distal portion (409, 509) so that this second part can be received within the sleeve. It can be advantageous that the space between the internal surface (606) of the sleeve body (603) and the external surface of the second part (418, 517) of the distal portion (409, 509) is minimal. When this space is minimal, the fluid flows from the exterior of the body piston directly (when the flow slit is a groove) or indirectly (via the internal volume of the distal portion of the piston body) into the internal volume of the sleeve body only through the flow slit. The internal diameter of this internal surface (606) is also smaller than the external diameter of the external surface (414, 514) of the first part (417, 516) of the distal portion (409, 509). This is advantageous because, when the piston (401, 501) is acted upon by the fluid in the first direction (A), the translation of the piston (401, 501) in the first direction (A) is stopped by the stop (416, 515) so that a minimum area of the flow slit (407, 507) is available for fluid flow.

The external surface (607) of the sleeve body (603) is a truncated cone having a circular section where the end delimited by the second surface (605) of the sleeve base (602) has an external diameter slightly bigger than the free end (608).

The sleeve base (602) is a cylinder having a circular section of substantially constant external diameter and being co-axial with the sleeve body (603). The length of the cylinder is smaller than the diameter so that the sleeve base (602) has a shape of a disc. The external diameter is larger than the external diameter of the end of sleeve body (603) being delimited by the second surface (605) of the sleeve base (602). The sleeve base (602) comprises one central orifice (609) having a diameter being substantially identical to the internal diameter of the sleeve body (603).

It is advantageous that the internal surface (606) of the sleeve body (603) and the external surface (414, 514) of the second part (418, 517) of the distal part (409, 509) of the piston body (403, 503) are cylinder with a circular section of substantially constant diameter. The space between the internal surface of this sleeve body (603) and the external surface of the second part (418, 517) of the distal portion (409, 509) remains minimal whatever the position of the piston (401, 501) is so that the piston (401, 51) is stabilized within the sleeve.

The piston body may comprise one or more flow slits. For example, FIGS. 7 and 8 show pistons comprising from one to four flow slits defining an orifice (701 to 707) or a groove (801 to 807).

Figure 9A:
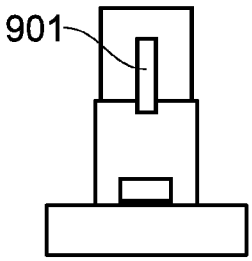
FIGS. 9*a*, 9*b* and 9*c* represent varying flow slit geometries.
Figure 9B:
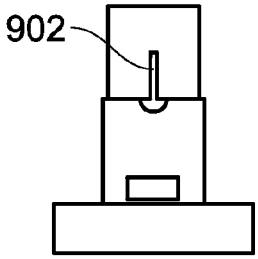
Figure 9C:
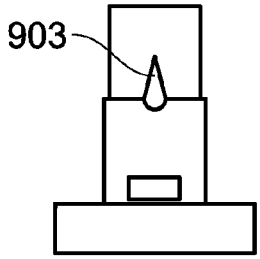
Figure 10A:
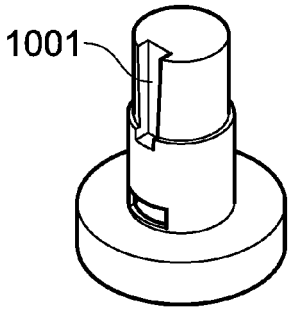
FIGS. 10*a* and 10*b* represent perspective views of two different piston embodiments of the invention wherein the flow slit is configured as a groove.
Figure 10B:
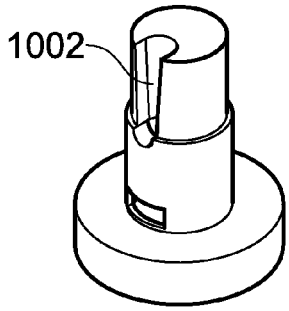

The shape of the flow slit may vary. For example, it is represented in FIG. 9 flow slits defining an orifice having three different shapes (901, 902, 903). Likewise, it is represented in FIG. 9 flow slits defining a groove having two different shapes (1001, 1002).

The pressure drop compensating member suitable to be placed in a fluid dispensing channel may be placed into a pressure drop compensating unit comprising the sleeve, the piston and the elastic member (embodiment not represented).

Figure 11:
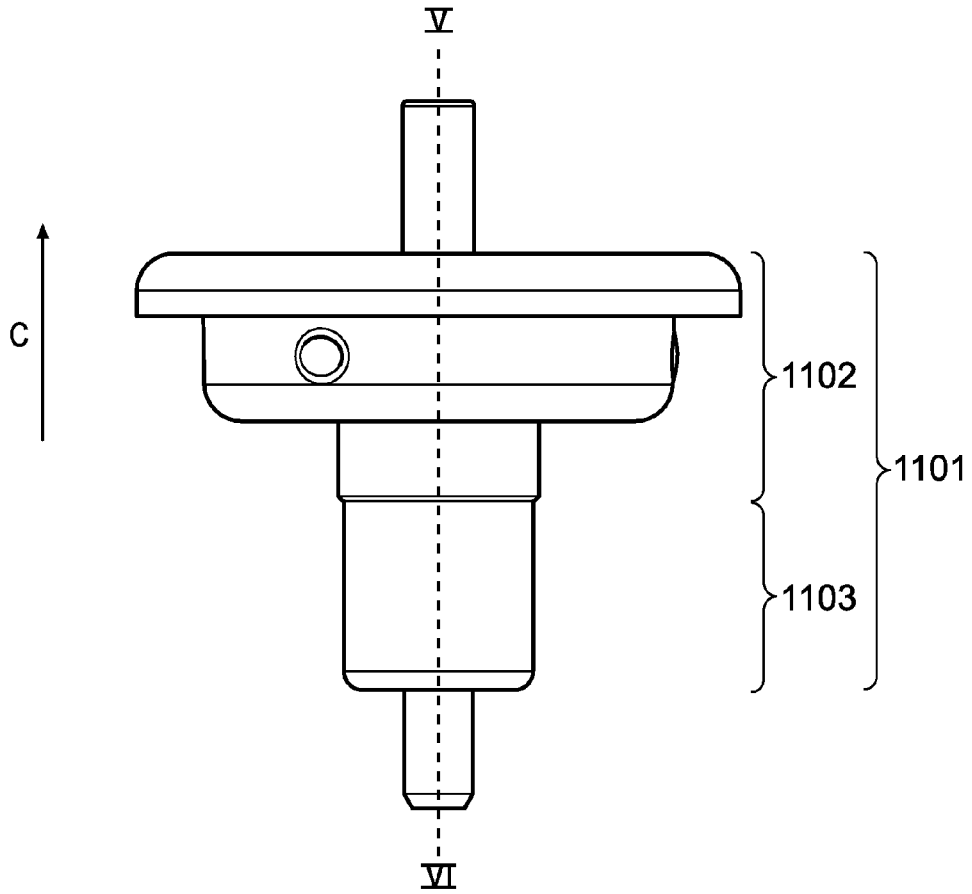
FIG. 11 represents a front view of an exemplary valve unit.
Figure 12:
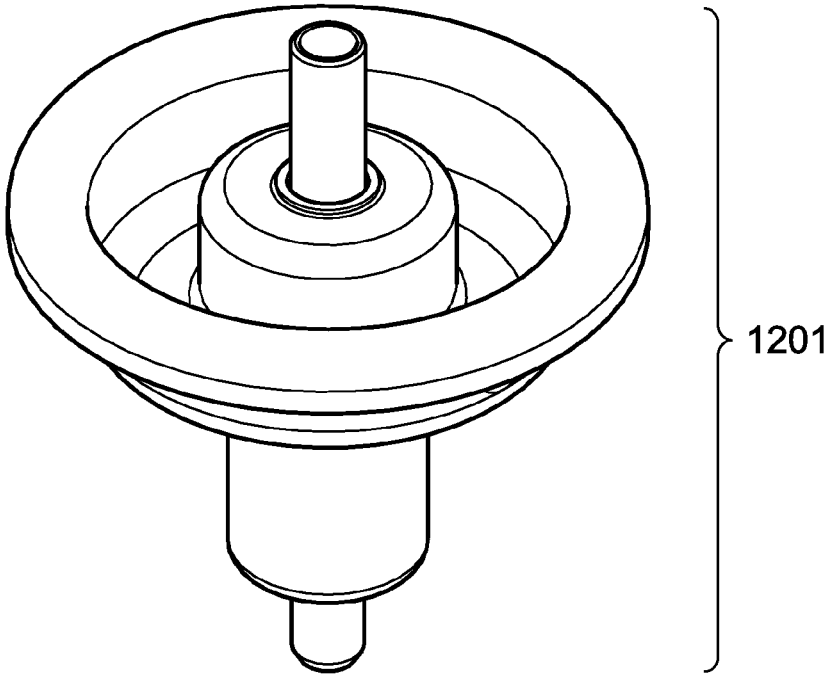
FIG. 12 represents a perspective view of the valve unit shown in FIG. 11.

Alternatively, the pressure drop compensating member may be placed within the valve unit (1101, 1201) as shown in FIGS. 11 and 12.

Figure 14:
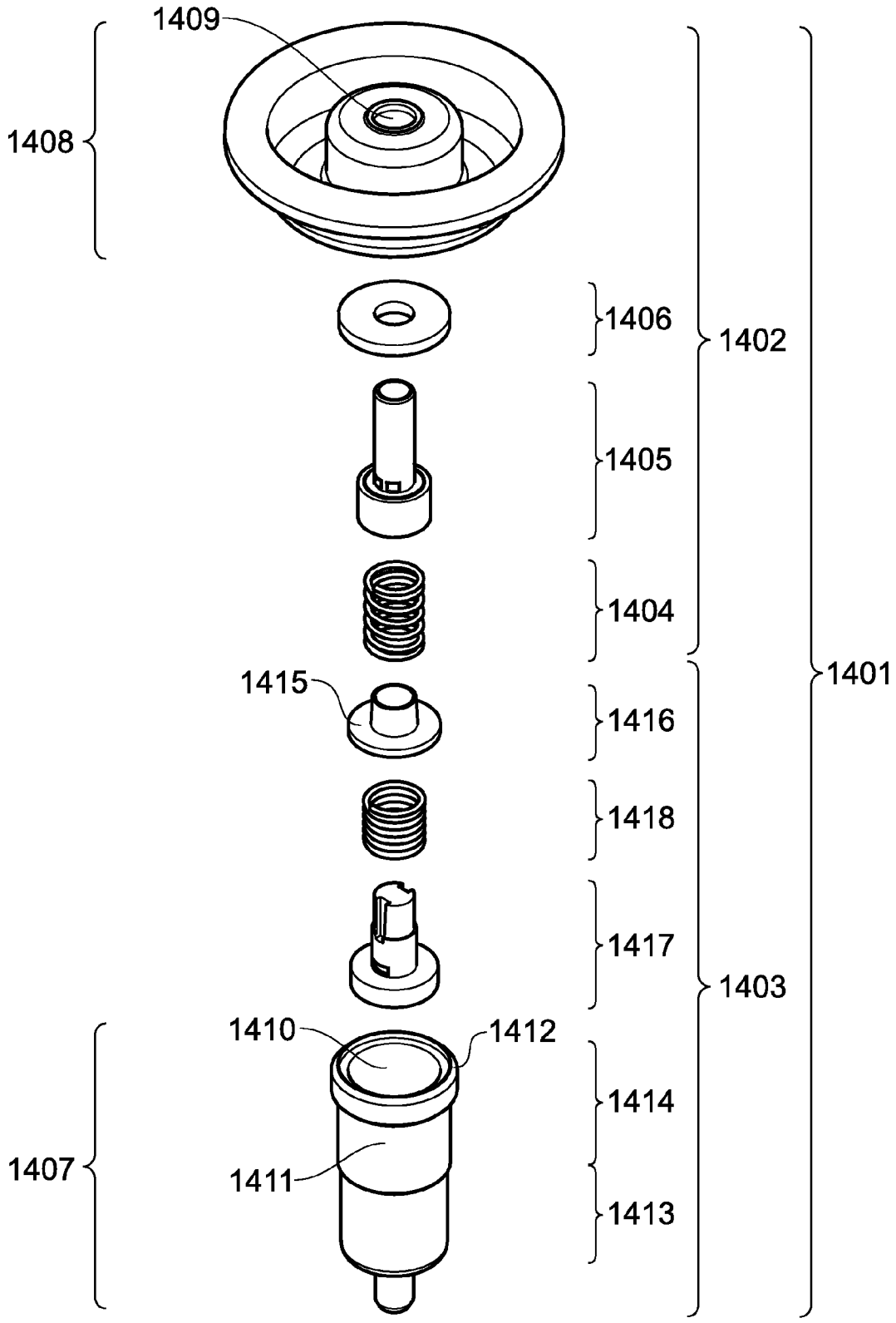
FIG. 14 is a perspective exploded view of the valve unit shown in FIGS. 11, 12 and 13.

In a preferred embodiment, the valve unit (1101) comprises a one-way valve (1102) adapted to allow fluid to flow through the valve in a flow direction (represented by arrow C) on actuation of the valve, and a pressure drop compensation member (1103) according to the present invention and located before the valve in the flow direction (C). The one-way valve (1102) may be any conventional valve known by the skilled person. As shown in FIGS. 13 and 14, the one-way valve (1302, 1402) comprises an actuating biasing means, preferably a spring (1304, 1404), a stem (1305, 1405), a gasket (1306, 1406).

The pressure drop compensating member (1303, 1403) and the one-way valve (1302, 1402) are enclosed within the valve body (1407) and the mounting cup (1408). The valve body (1407) comprises a flow duct (1307) adapted to allow fluid to flow into the valve unit and the mounting cup (1408) comprises an orifice (1409) into which the stem (1305, 1405) can be inserted.

The valve body (1407) comprises a peripheral wall (1308) and a transversal wall (1309). This peripheral wall (1308) has an internal surface (1410) and an external surface (1411), the internal surface (1410) defining an internal volume that is delimited at one end by this transversal wall (1309), and at the other by a free end (1412).

The peripheral wall (1308) comprises two parts being cylinders having a circular section and being co-axial to each other. The first part (1413) is attached to the transversal wall (1309) and the second part (1414), attached to the first part (1413), is distant to the transversal wall (1309) and comprises a free end (1412). The mounting cup (1408) is attached to this free end (1412). The internal diameter of the first part (1413) is smaller that the internal diameter of the second part (1414) and the interface between the internal surfaces of the first and the second part (1413, 1414) of the peripheral wall (1308) forms a step (1310). The external diameter of the first part (1413) may be smaller, substantially identical or bigger than the external diameter of the second part (1414).

The transversal wall (1309) has a shape of a disc comprising a first surface (1311) and a second surface (1312), the first surface (1311) being attached to the first part (1413) of the valve body (1407). The transversal wall (1309) has an external diameter being substantially identical to the external diameter of the first part (1413) of the valve body (1407). This transversal wall (1309) comprises at least one flow duct (1307) adapted to allow the fluid to flow through the transversal wall (1309) into the valve body (1407). Preferably, the transversal wall (1309) comprises one central flow duct (1307) being co-axial with this transversal wall (1309).

The external diameter of the sleeve base (1415) is substantially identical to the internal diameter of the second part (1414) of the body valve (1407). The first surface (1313) of the base (1415) of the sleeve (1416) seats on the step (1310) of the valve body (1407) and the sleeve (1415) is static into the valve body (1407). The sleeve (1416) divides the internal volume of the valve in two compartments.

The first compartment is delimited by the internal surface (1410) of the first part (1413) of the valve body (1407), the first surface (1311) of the transversal wall (1309) and the first surface (1313) of the sleeve (1416). This compartment comprises the piston (1417) and the elastic member (1418) capable of acting on the piston. The length of the first compartment, i.e. the length of the internal surface of the first part (1413) of the valve body (1407), is smaller than the total length of the piston (1417), the total length of the piston (1417) including the base, the distal portion and proximal portions of the piston. The length of the first compartment is bigger than the cumulative length of the base and the proximal portion of the piston. The difference between the length of the first part of the valve body and the total length of piston corresponds to the part of the distal portion of the body of the piston being permanently received within the sleeve. When the pressure exerted by the fluid on the piston (1407) is minimal, the base of the piston (1407) seats on the first surface (1311) of the transversal wall (1309) of the valve body (1407).

The second compartment is delimited by the internal surface (1410) of the second part (1414) of the valve body (1407), the mounting cup (1408) and the second surface of the sleeve base (1415). This compartment comprises the actuating biasing means (1304, 1404), the stem (1305, 1405) and the gasket (1306, 1406), these actuating biasing means, stem and gasket being conventional. The actuating biasing means seats on the second surface of the sleeve base (1415).

In use, when the valve is activated, e.g. by pressing an actuator, the fluid flows through the flow duct of the transversal wall of the valve body into the first compartment and flows into the internal volume of the proximal portion of the body through the central flow duct of the piston base. Then, the fluid flows from the internal volume of the proximal portion to the exterior of the piston body through each flow duct of the proximal portion. Then the fluid flows from the exterior of the piston body into the internal volume of the sleeve through each flow slit of the distal portion of the piston body. When the flow slit defines a groove, the fluid flows directly from the exterior of the piston body into the internal volume of the sleeve. When the flow slit defines an orifice, the fluid flows indirectly from the exterior of the piston body into the internal volume of the sleeve, i.e. the fluid flows from the exterior of the body piston into the internal volume of the distal portion through the flow slits defining an orifice and, then, the fluid flows from this internal volume into the internal volume of the sleeve through the free end of the distal portion. The fluid, then, flows through the one-way valve before being discharged.

The present invention also relates to a container adapted for dispensing a pressurized fluid comprising a dispensing fluid channel, this channel comprising a pressure drop compensation member or a valve unit. Any conventional container adapted for dispensing a pressurized fluid can be used. This container may comprise a peripheral wall delimitating an internal volume and comprising an orifice onto which the fluid dispensing channel may be mounted. Preferably, the container comprises a peripheral wall being cylinder with a circular section of substantially constant diameter and a transversal wall. This peripheral wall is delimited at one end by the transversal wall attached thereto and at the other, by a free end onto which the mounting cup is attached. The internal volume of the container comprises the chamber comprising the composition.

In a preferred embodiment, the container chamber comprises a pressurized personal care composition, preferably a pressurized shaving care composition.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A pressure drop compensation member suitable to be placed in a fluid dispensing channel, the pressure drop compensation member comprising:

(a) a sleeve;

(b) a piston adapted to be acted upon by a fluid in a first direction, the piston comprising one or more flow slits through which all of said fluid flows through the piston, the piston comprising:

1. a base comprising a first surface adapted to be acted upon by the fluid in the first direction, a second surface, and one or more flow ducts fluidly linking the first surface with the second surface to allow fluid to flow through the base; and
2. a body comprising a body proximal portion attached to the second surface of the base, a body distal portion attached to the proximal portion and an internal wall disposed at the interface of the body proximal portion and the body distal portion, wherein the body distal portion comprises the one or more flow slits, defines a distal portion free end and a distal portion internal volume and is at least partially received within the sleeve and wherein the body proximal portion comprises:
   i. a peripheral wall including a proximal portion internal surface and a proximal portion external surface, the proximal portion internal surface defining a proximal portion internal volume that is delimited at one end by the base and, at the other, by the body distal portion, wherein the one or more flow ducts of the base communicates directly with the proximal portion internal volume to allow fluid to flow through the base to the proximal portion internal volume, and
   ii. one or more flow apertures fluidly linking the proximal portion internal surface with the proximal portion external surface to allow fluid to flow from the proximal portion internal volume to the exterior of the proximal portion, wherein the internal wall prevents the fluid from flowing directly from the proximal portion internal volume to the distal portion internal volume; and (c) an elastic member capable of acting on the piston in a second direction opposite to the first direction;

wherein the piston is slidably movable within the sleeve to adjust the area of each of the one or more flow slits, subject to a minimum area of each of the one or more flow slits always being available for fluid flow, and wherein, in use, if the pressure exerted by the fluid on the piston drops, the elastic member acts to move the piston in relation to the sleeve to increase the area of each of the one or more flow slits in order to maintain a substantially constant flow of fluid through the fluid dispensing channel.

2. The pressure drop compensation member according to claim 1, wherein the body comprises a stop for the sleeve such that a minimum area of each of the one or more flow slits is available for fluid flow.

3. The pressure drop compensation member according to claim 1, wherein each of the one or more flow slits defines a groove extending from the free end of the body distal portion towards the base to allow fluid to flow from the exterior of the body distal portion into the sleeve.

4. The pressure drop compensation member according to claim 1, wherein the body distal portion comprises a peripheral wall including a distal portion internal surface and a distal portion external surface, the distal portion internal surface defining a distal portion internal volume that is delimited at one end by the body proximal portion and, at the other, by the distal portion free end, wherein each of the one or more flow slits defines an orifice extending from the distal portion external surface to the distal portion internal surface to allow fluid to flow from the exterior of the distal portion into the distal portion internal volume, and wherein the distal portion free end defines an exit orifice to allow fluid to flow from the distal portion internal volume into the sleeve.

5. A valve unit comprising:

(a) a one-way valve adapted to allow fluid to flow through the valve in a flow direction upon actuation of the one-way valve; and (b) a pressure drop compensation member according to claim 1, located before the one-way valve in relation to the flow direction.

6. A container adapted for dispensing a pressurized fluid comprising a dispensing fluid channel comprising a pressure drop compensation member according to claim 1.

7. The container according to claim 6 comprising a chamber comprising a pressurized personal care composition, such as comprising a pressurized shaving care composition.

8. The container according to claim 6, wherein the dispensing fluid channel further comprises a one-way valve disposed after the pressure drop compensation member in relation to the fluid flow direction.

* * * * *